US005880652A

United States Patent [19]

Snel

[11] Patent Number: 5,880,652

[45] Date of Patent: Mar. 9, 1999

[54] STRIPLINE FILTER WITH STRIPLINE RESONATORS OF VARYING DISTANCE THEREBETWEEN

[75] Inventor: Jan Snel, Roermond, Netherlands

[73] Assignee: U.S. Philips Corporation, New York, N.Y.

[21] Appl. No.: 867,141

[22] Filed: Jun. 2, 1997

[30] Foreign Application Priority Data

Jun. 7, 1996 [EP] European Pat. Off. ..... 96201591.3

[51] Int. Cl.[6] ..... H01P 1/203

[52] U.S. Cl. ..... 333/204; 333/219

[58] Field of Search ..... 333/203–205, 333/219, 116, 110

[56] References Cited

U.S. PATENT DOCUMENTS

| | | | |
|---|---|---|---|
| 3,451,015 | 6/1969 | Heath | 333/204 X |
| 3,528,038 | 9/1970 | Tresselt | 333/116 |
| 4,612,689 | 9/1986 | De Wild et al. | 29/25.42 |
| 4,701,727 | 10/1987 | Wong | 333/204 |
| 5,248,949 | 9/1993 | Eguchi et al. | 333/204 |
| 5,334,961 | 8/1994 | Shirai et al. | 333/219 X |
| 5,355,524 | 10/1994 | Higgins, Jr. | 333/204 X |
| 5,361,050 | 11/1994 | Einbinder | 333/204 |
| 5,506,553 | 4/1996 | Makita et al. | 333/204 |

FOREIGN PATENT DOCUMENTS

| | | | |
|---|---|---|---|
| 0541397 | 5/1993 | European Pat. Off. . | |
| 0638953A1 | 2/1995 | European Pat. Off. . | |
| 28 56 114 | 6/1980 | Germany | 333/204 |
| 62-164301 | 7/1987 | Japan | 333/204 |

OTHER PUBLICATIONS

"Microwave Filters, Impedance Matching Networks and Coupling Structures" By G. L. Matthaei et al, Mc Graw–Hill Book Company 1964, pp. 217–229.

*Primary Examiner*—Seungsook Ham
*Attorney, Agent, or Firm*—Dicran Halajian

[57] ABSTRACT

A stripline filter is disclosed having two stripline resonators which are mutually coupled. In order to be able to influence the type of coupling, such as inductive, capacitive or a combination thereof, the distance between the stripline resonators changes along their length. If the stripline resonators are shorted at the end where the distance between them has a minimum value, then the coupling is substantially inductive. If the stripline resonators are open or capacitively loaded at the end where the distance between the resonators has a minimum value, then the coupling is substantially capacitive.

16 Claims, 5 Drawing Sheets

STRIPLINE FILTER WITH STRIPLINE RESONATORS OF VARYING DISTANCE THEREBETWEEN

BACKGROUND OF THE INVENTION

The present invention is related to a stripline filter comprising at least a first stripline resonator being coupled to a second stripline resonator.

The invention is also related to a receiver using such a stripline filter.

A stripline filter according to the preamble is known from published European Patent application No. 541 397.

Such filters are especially used in transmitters and receivers for high-frequency signals, such as transmitters and receivers for GSM, PCN and DECT.

GSM (Global System for Mobile Communication) is a digital cellular mobile telephony system which utilizes high-frequency signals in the 900 MHz band.

PCN (Personal Communication Network) is a digital cellular mobile telephony system intended for small portable telephones and utilizes a frequency of 1800 MHz.

DECT (Digital European Cordless Telephone) is especially intended for cordless telephony over a relatively short distance between the wireless telephone and the dedicated base station. DECT operates as does PCN at a frequency of about 1800 MHz.

The present filters are especially used for suppressing undesired signals that have a frequency lying outside the range assigned to that particular system. This suppression is necessary, because without filtering, the receiver may easily be overloaded by strong transmitters transmitting from outside this range.

The known filter utilizes at least two mutually coupled stripline resonators. The input and output of the filter may be coupled to the resonator in different ways. Several examples of such a coupling are described in the book entitled "Microwave Filters, Impedance Matching Networks and Coupling Structure" by G. L. Matthaei, L. Young and E. M. T. Jones, published by Mc Graw-Hill Book Company 1964, pages 217–229.

In the stripline filter according to the above mentioned European patent application the only ways of varying the transfer function of the stripline filter are varying the resonance frequency of the resonators and the strength of their coupling.

OBJECTS AND SUMMARY OF THE INVENTION

An object of the present invention is to provide a stripline filter according the preamble having more ways of varying the transfer function.

Therefor the stripline filter according to the invention is characterized in that the distance between the first stripline resonator and the second stripline resonator varies over the length of said stripline resonators.

By varying the distance between the stripline resonators over the length of the stripline resonator, it becomes possible to choose the type of coupling between the stripline resonators. The coupling can be made inductive, capacitive or a combination of both. If the distance between the stripline resonators has a minimum value for the position in which the current in the stripline resonators has a maximum value, the coupling is substantially inductive. If the distance between the stripline resonators has a minimum value for the position in which the voltage of the stripline resonators has a maximum value, the coupling is substantially capacitive.

It is observed that U.S. Pat. No. 3,528,038 discloses two coupled striplines having a distance varying over the length of the striplines. It is observed that the above mentioned U.S. patent is related to the broadband directional couplers. The varying distance is applied in order to increase the bandwidth of the directional coupler. The use of stripline resonators with a varying distance for use in filters is neither disclosed nor suggested in the above mentioned U.S. patent.

An embodiment of the invention is characterized in that the distance between the stripline resonator has its minimum value at a first end of the stripline resonators.

If the distance between the stripline resonators has a minimum value at a first end of the stripline resonator, it is easily to obtain substantially inductive or capacitive coupling. If the stripline resonator is shorted at the first end, the current has a maximum value and the voltage has a minimum value in the neighborhood of the first end. The coupling between the stripline is now substantially inductive. If the stripline resonator is open (or capacitively loaded) at the first end, the current has a minimum value and the voltage has a maximum value at the first end of the stripline resonator. The coupling is now substantially capacitive.

A further embodiment of the invention is characterized in that the distance between the first stripline resonator and the second stripline resonator varies gradually over the length of said stripline resonators.

Experiments have shown that using a gradually changing distance between the stripline resonators allows to maximize one type of coupling (inductive or capacitive) and minimize the other type of coupling (capacitive or inductive). This results in a decreased insertion loss.

A further embodiment of the invention is characterized in the stripline resonators are positioned in two substantially parallel planes. By coupling the striplines via the broad side by placing them in two parallel planes, the insertion loss is lower that in the situation where the striplines are place in one plane.

A still further embodiment of the invention is characterized in that the stripline resonators are accommodated in a multi-layer dielectric.

By embedding the striplines in a multilayer dielectricum, the dimensions of the filter can substantially be reduced. Suitable dielectric materials are ceramics such as barium oxide, calcium oxide etc. or mixtures thereof.

BRIEF DESCRIPTION OF THE DRAWINGS

The invention will now be explained with reference to the drawings. Herein shows.

DETAILED DESCRIPTION OF THE PREFERRED EMBODIMENTS

Figure 2:
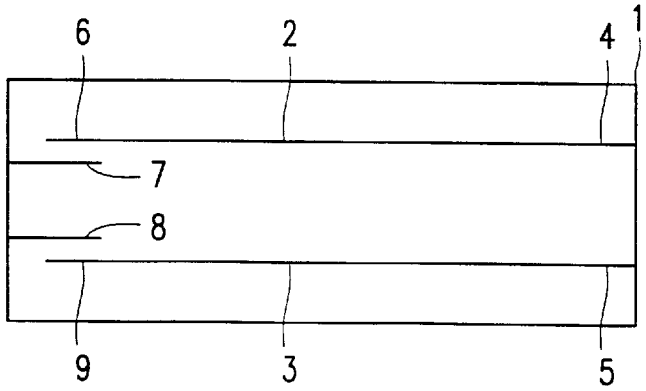
FIG. 2, a cross section of the filter according to FIG. 1.

The stripline filter according to FIG. I comprises a dielectric body in which a first stripline resonator 2 and a second stripline resonator 3 are incorporated. The stripline resonators 2 and 3 are positioned in two parallel planes as can be seen in FIG. 2. The distance between the resonators 2 and 3 varies over their length from a minimum value at the first ends 6 and 9, via an intermediate value in the middle of the resonators to a maximum value at the second ends 4 and 5. The stripline resonators are capacitively loaded at the first ends 6 an 9 by capacitor plates 7 and 8. The stripline resonators are shorted at the second ends 4 and 5. The length of the stripline resonators is e.g. $\lambda/8$. The value of the capacitive load is chosen to obtain the behavior of a $\lambda/4$ resonator.

The voltage between the stripline resonator and ground is zero at the second ends 4 and 5 and increases towards the first ends 6 and 9. The current in the stripline resonators has a maximum value at the second ends 4 and 5 and decreases towards the first ends 6 and 9. Due to the minimum distance between the stripline resonators 2 and 3 and the maximum voltage at the first ends 6 and 9 the coupling between the two stripline resonators is to a large extent capacitive. Due to the area in the middle of the resonators there is some inductive coupling too.

Figure 3:
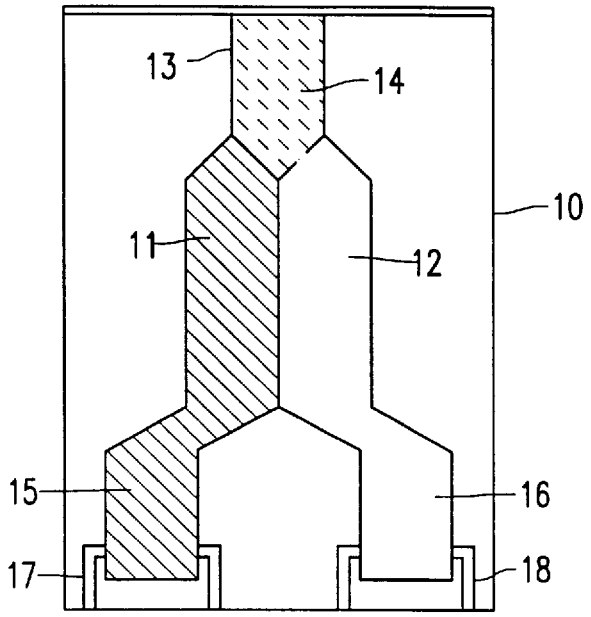
FIG. 3, a stripline filter according to a second embodiment of the invention.

The filter according to FIG. 3 comprises two stripline resonators 11 and 12. Now the first ends 13 and 14 are shorted, and the second ends 15 and 16 are capacitively loaded by the capacitor plates 17 and 18. Because the current in the stripline resonators 11 and 12 has a maximum value at the first end, the coupling between the stripline resonators 11 and 12 will be substantially inductive, this being in contradistinction with the stripline filter according to FIG. 1.

Figure 4:
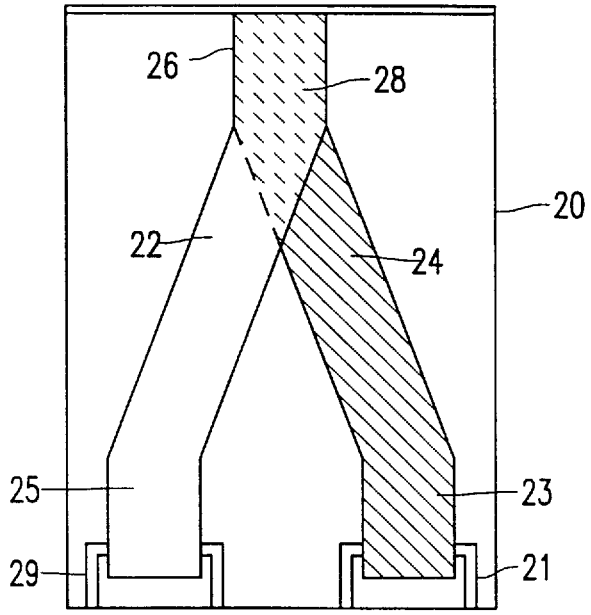
FIG. 4, a stripline filter according to a third embodiment of the invention.

The stripline filter 20 according to FIG. 4 is similar as the stripline filter 10 according to FIG. 3, but in the filter according to FIG. 4 the distance between the striplines 22 and 24 varies gradually instead of stepwise as in the stripline filter 10 according to FIG. 3. The gradual variation of the distance causes a reduced amount of capacitive coupling, due to the absence of the middle area of the filter according to FIG. 3.

Figure 5:
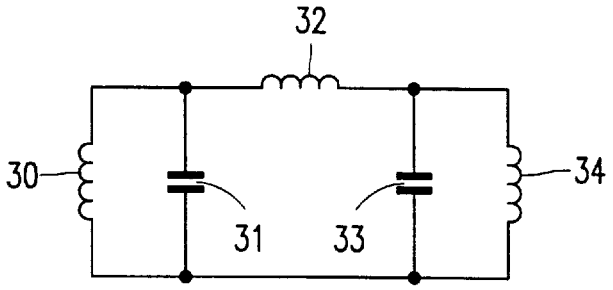
FIG. 5, an equivalent circuit diagram of the filter according to FIG. 4.

FIG. 5 shows an equivalent circuit diagram corresponding to the filter according to FIG. 4. The parallel resonance circuit comprising the inductor 30 and the capacitor 31 corresponds to the stripline 22 loaded by the capacitor plates 29. The parallel resonance circuit comprising the inductor 34 and the capacitor 33 corresponds to the stripline 24 loaded by the capacitor plate 21. The inductive coupling of the striplines 22 and 24 is modelled by the inductor 32.

If the striplines 22 and 24 are tuned to the same frequency, the filter according to FIG. 4 and FIG. 5 shows a minimum attenuation for the resonance frequency to which the striplines 22 and 24 are tuned. For a certain frequency higher than the resonance frequency of the striplines, the filter will display a notch due to a series resonance circuit formed by the inductor 32, the inductor 34 and the capacitor 33.

Figure 6:
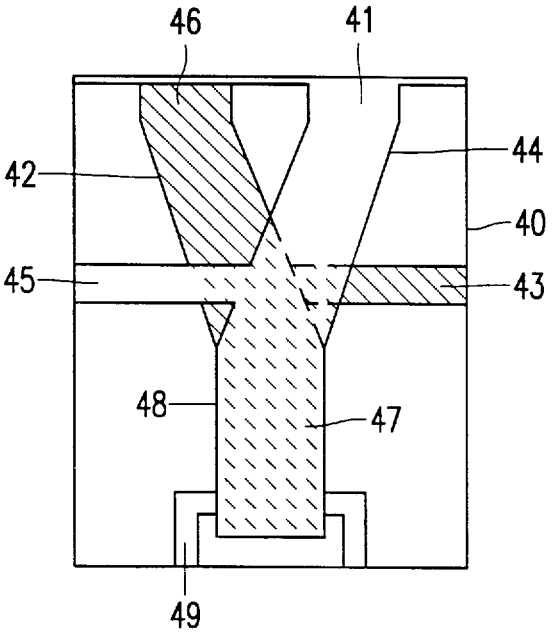
FIG. 6, a stripline filter according to a fourth embodiment of the invention.

The stripline filter according to FIG. 6 comprises the striplines 42 and 44 which are shorted at the second end 46 and 41. The stripline resonators 42 and 44 are capacitively loaded by a capacitor plate 49. The coupling between the resonators 42 and 44 is substantially capacitive due to the minimum distance between the stripline resonators at the first end. The input 45 and the output 43 of the stripline filter 40 are coupled to the stripline resonators by galvanic taps on the striplines 42 and 44.

Figure 7:
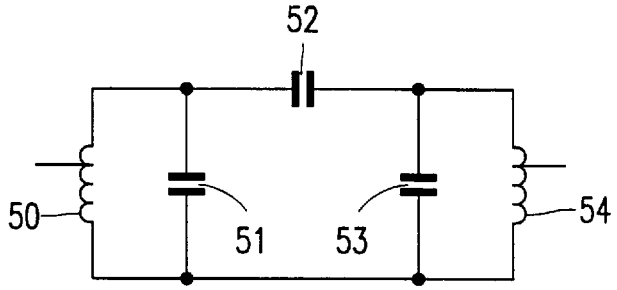
FIG. 7, an equivalent circuit diagram of the filter according to FIG. 6.

FIG. 7 shows the equivalent diagram of the stripline filter 40 according to FIG. 6. The inductor 50 and the capacitor 51 correspond to the stripline resonator 44. The input 45 corresponds to the tap on the inductor 50. The inductor 54 and the capacitor 53 correspond to the stripline resonator 42. The capacitor 52 corresponds to the capacitive coupling between the stripline resonators 42 and 44. The filter according to FIG. 7 shows a maximum transfer function for the resonance frequency of the striplines, and it shows a notch for a frequency below the resonance frequency of the stripline resonators 42 and 44.

Figure 8:
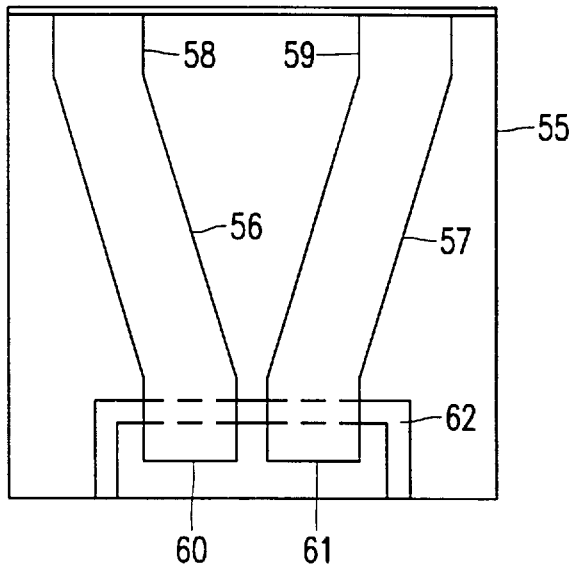
FIG. 8, a stripline filter in which the striplines are positioned in one plane.
Figure 9:
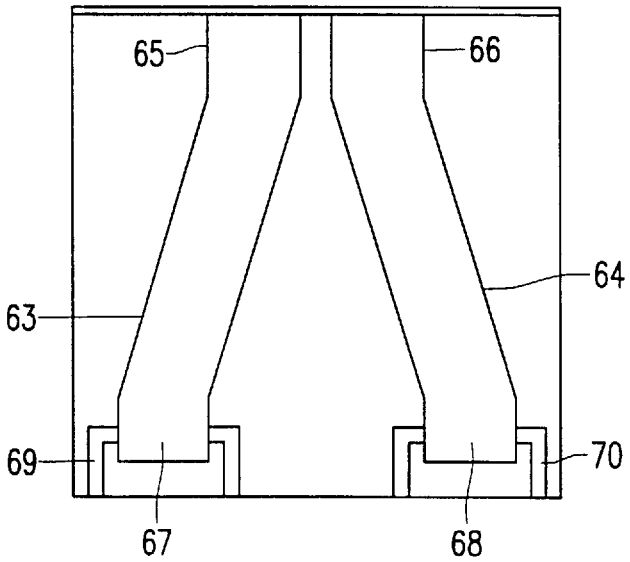
FIG. 9, a second embodiment of a stripline filter in which the striplines are positioned in one plane.

FIG. 8 shows a variant of the stripline filter according to FIG. 6. In the stripline filter according to FIG. 8 the striplines 56 and 57 are placed in one single plane. FIG. 9 shows a variant of the filter according to FIG. 4. In the filter according to FIG. 9 again the striplines 63 and 64 are placed in one single plane.

Figure 10:
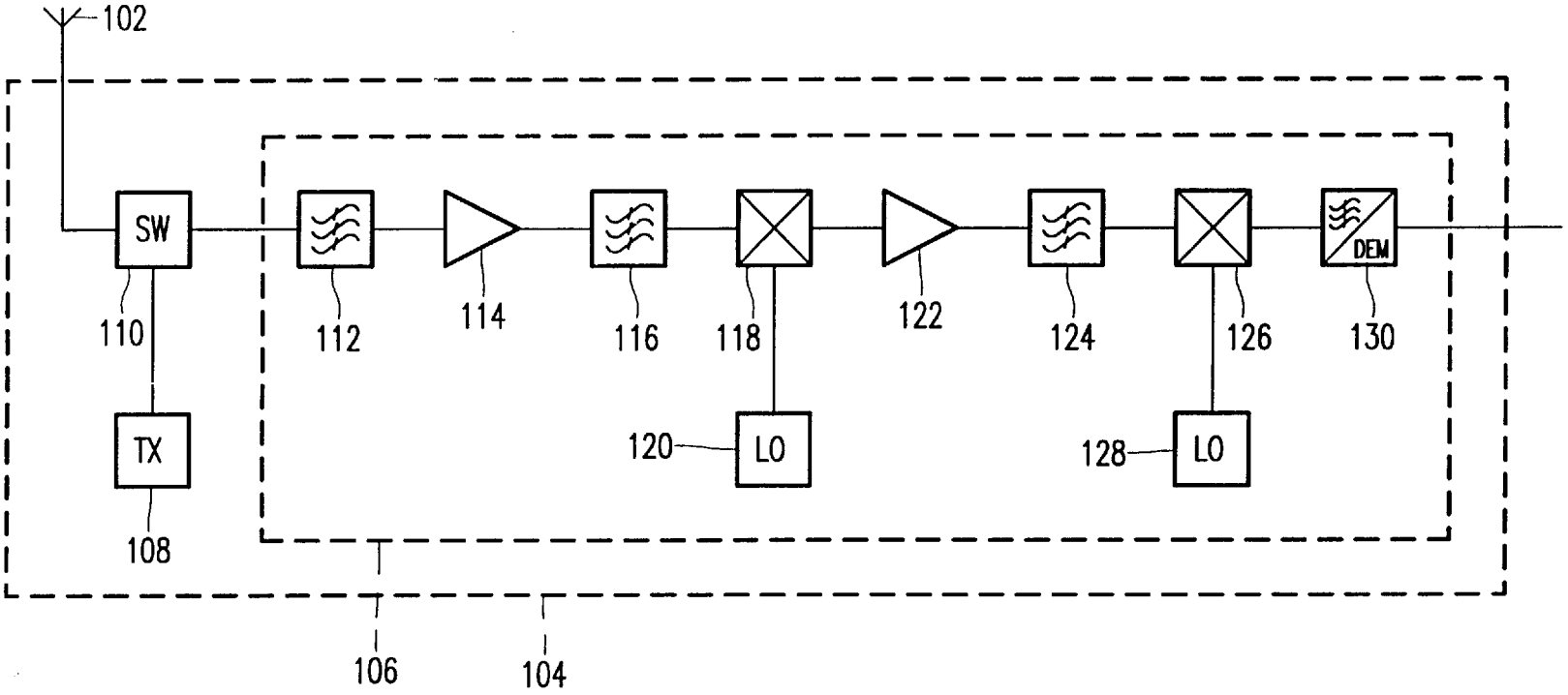
FIG. 10, a transceiver according to the invention.

In FIG. 10 an aerial 102 is connected to an input/output of the transceiver 104. The input/output of the transceiver 104 is connected to a transceiver switch 110. An output of the transceiver switch 110 is connected to an input of a receiver 106.

The input of the receiver 106 is connected to an input of a bandpass filter 112 according to the inventive idea. The output of the bandpass filter 112 is connected to an input of an amplifier 114. The output of the amplifier 114 is connected to an input of a bandpass filter 116 whose output is connected to a first input of the frequency converter means in this case formed by a first mixer 118. An output of a first oscillator 120 is connected to a second input of the first mixer 118. The output of the first mixer 118 is connected to an input of an amplifier 122. The output of the amplifier 122 is connected to an input of a SAW filter 124 (Surface Acoustic Wave). The output of the SAW filter 124 is connected to a first input of a second mixer 126. An output of a second oscillator 128 is connected to a second input of the second mixer 126. The output of the second mixer 126 is connected to an input of a filter/demodulator 130. The output of the filter/demodulator 130 also forms the output of the receiver 106. A signal to be transmitted is applied to a transmitter 108, whose output is connected to an input of the transceiver switch 110.

The transceiver 104 as shown in FIG. 10 is arranged to be used in a duplex transmission system in which the transmitter and receiver need not necessarily be switched on simultaneously. Examples of such transmission systems are GSM, PCN and DECT. The advantage of this is that the transceiver 104 may be considerably simpler than a transceiver arranged for full duplex operation in which transmitter and receiver can operate simultaneously. The latter transceivers require complex duplex filters to avoid the output signal of the transmitter ending on the input of the receiver.

If the transceiver switch 110 is in the receive mode, the received signal is transferred to the bandpass filter 112. For DECT this bandpass filter has a center frequency of 1890 MHz and a bandwidth of 150 MHz. The output signal of the bandpass filter 112 is amplified by the amplifier 114 and subsequently applied to a bandpass filter 116 which is identical to the bandpass filter 112.

The output signal of the bandpass filter 116 is mixed in the mixer 118 with a signal coming from the first oscillator 120, which signal has a frequency in the range from 1771–1787 MHz. The output signal of the mixer 118 is amplified by the amplifier 122 and the SAW filter 124 selects the component having a center frequency of 110.592 MHz from the output signal of the amplifier 122.

This output signal is mixed in a second mixer 126 with a signal having a frequency of 100 MHz which comes from the second oscillator 128. The output of the mixer 126 then carries a signal that has a center frequency of 10.592 MHz which is then filtered and demodulated by the filter/demodulator 130.

The signal to be transmitted is modulated on a carrier by the transmitter 108 which carrier has a frequency that is equal to that of the received signal in the case of DECT. The output signal of the transmitter 108 is conveyed to the aerial 102 via the transceiver switch 110.

Figure 1:
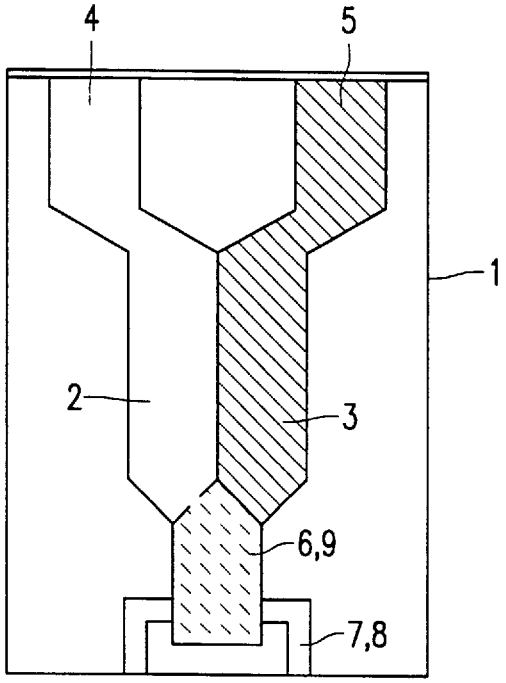
FIG. 1, a stripline filter according to a first embodiment of the invention.

The filter 112, 116 of FIG. 1 is realized with a multi-coating technique. The filter consists of stacked foils which are sintered, during which operation the foils have at the proper places palladium tracks provided for forming strip line resonators and so on and so forth. It is conceivable that another metal such as, for example, copper or silver may be substituted for palladium. The sintering is preferably effected under a uniaxial pressure, so that the dimensions of the filter in the plane of the foils do not change during sintering. The foils are formed from a mixture of powder of a ceramic material and an organic binding agent. Said technique is described in more detail in U.S. Pat. No. 4,612,689. Alternatively, it is possible that the strip line resonators consist of two metal layers separated by a thin ceramic layer in lieu of a single metal layer. This leads to less attenuation of the filter in the passband.

I claim:

1. A stripline filter comprising:

a first stripline resonator located on a first plane; and a second stripline resonator located on a second plane, a distance between said first stripline resonator and said second stripline resonator varying along a length of said first and second stripline resonators, and a first part of said first stripline resonator overlapping a first portion of said second stripline resonator, and wherein said first and second stripline resonators are parallel to each other along said length.

2. The stripline filter of claim 1, wherein the distance between the stripline resonators has a minimum value at a first end of the stripline resonators where said first part overlaps said first portion.

3. The stripline filter of claim 1, wherein the distance between the first stripline resonator and the second stripline resonator varies gradually along the length of said stripline resonators.

4. The stripline filter of claim 1, wherein one end of the first and second stripline resonators is capacitively loaded.

5. The stripline resonator of claim 1, wherein one end of the first and second stripline resonators is substantially shorted.

6. The stripline resonator of claim 1, wherein said first part and said first portion are one of being capacitively loaded and substantially shorted.

7. The stripline filter of claim 1, wherein the first plane is substantially parallel to the second plane.

8. The stripline filter of claim 1, wherein the first and second stripline resonators are accommodated in a multi-layer dielectric.

9. A receiver which receives an input signal at an input connected to a filter, said filter comprising two stripline resonators located on two planes, said filter being connected to a frequency converter for converting the input signal into a signal having a lower center frequency than said input signal, wherein a distance between the two stripline resonators varies over a length of the stripline resonators, a first part of one of said two stripline resonators on one of said two planes overlapping a first portion of another of said two stripline resonators on another of said two planes, and wherein said two stripline resonators are parallel to each other along said length.

10. The receiver of claim 9, wherein the distance between the two stripline resonators has a minimum value at a first end of the two stripline resonators where said first part overlaps said first portion.

11. The receiver of claim 9, wherein the distance between the two stripline resonators varies gradually over the length of the two stripline resonators.

12. The receiver of claim 9, wherein one end of the two stripline resonators is capacitively loaded.

13. The receiver of claim 9, wherein one end of the two stripline resonators is substantially shorted.

14. The receiver of claim 9, wherein said first part and said first portion are one of being capacitively loaded and substantially shorted.

15. The receiver of claim 9, wherein the two planes are substantially parallel.

16. The receiver claim 9, wherein the two stripline resonators are accommodated in a multi-layer dielectric.

* * * * *